US007857538B2

(12) United States Patent
Nasu et al.

(10) Patent No.: US 7,857,538 B2
(45) Date of Patent: Dec. 28, 2010

(54) FILLER EXTRUDING CONTAINER FOR COATING

(75) Inventors: Mieko Nasu, Yokohama (JP); Tomochika Fujioka, Yokohama (JP); Yoshikazu Tani, Tokyo (JP); Takakazu Obana, Tokyo (JP)

(73) Assignees: Tokiwa Corporation, Gifu (JP); Shiseido Co., Ltd., Tokyo (JP)

( * ) Notice: Subject to any disclaimer, the term of this patent is extended or adjusted under 35 U.S.C. 154(b) by 937 days.

(21) Appl. No.: 11/664,643

(22) PCT Filed: Sep. 7, 2005

(86) PCT No.: PCT/JP2005/016429

§ 371 (c)(1),
(2), (4) Date: Apr. 4, 2007

(87) PCT Pub. No.: WO2006/051646

PCT Pub. Date: May 18, 2006

(65) Prior Publication Data

US 2008/0107472 A1 May 8, 2008

(30) Foreign Application Priority Data

Nov. 10, 2004 (JP) ..... 2004-326938

(51) Int. Cl.
*B43K 1/06* (2006.01)

(52) U.S. Cl. ..... 401/265; 401/263; 401/171

(58) Field of Classification Search ..... 401/261–266, 401/175, 171

See application file for complete search history.

(56) References Cited

U.S. PATENT DOCUMENTS 3,212,685 A 10/1965 Swan et al.

(Continued)

FOREIGN PATENT DOCUMENTS

JP 60-80717 6/1985

(Continued)

OTHER PUBLICATIONS

Notification of Transmittal of Copies of Translation of the International Preliminary Report on Patentability (Chapter I or Chapter II of the Patent Cooperation Treaty) (5 pages).

(Continued)

*Primary Examiner*—David J Walczak
(74) *Attorney, Agent, or Firm*—Osha Liang LLP

(57) ABSTRACT

The outer face of a distal end part having a discharge opening 1*c* at the distal end of an applicator 100 is a sloped face 1*a*, so that skin or another surface to be coated can be coated favorably, and when a moving body 6 advances as far as it can, an elastic body 9 provided to the distal end of the moving body 6 hits a sloped face 1*b* that is the inner face of the distal end part having the discharge opening 1*c* at the distal end of the applicator 100, and elastically deforms along said sloped face 1*b*, and an application material L that could not be pushed out with a conventional piston and would remain in a substantially hoof-shaped (sloped cylindrical) space (a space including the sloped face 1*b* within the applicator distal end) can be completely pushed out by the elastic body 9, leaving almost none behind, so that all of it can be consumed.

10 Claims, 10 Drawing Sheets

U.S. PATENT DOCUMENTS

| | | | | |
|---|---|---|---|---|
| 4,323,157 | A | 4/1982 | Idec | |
| 5,839,622 | A * | 11/1998 | Bicknell et al. | 222/390 |
| 6,186,686 | B1 | 2/2001 | Neuner et al. | |
| 6,488,427 | B1 * | 12/2002 | Breidenbach et al. | 401/75 |

FOREIGN PATENT DOCUMENTS

| | | | |
|---|---|---|---|
| JP | 60-80718 | | 6/1985 |
| JP | 8-229461 | | 9/1996 |
| JP | 8-229462 | | 9/1996 |
| JP | 9-206377 | | 8/1997 |
| JP | 10-192049 | | 7/1998 |
| JP | 10-192050 | | 7/1998 |
| JP | 2000-262324 | | 9/2000 |
| JP | 2004-89687 | | 3/2004 |
| WO | WO-03/017799 | A1 | 3/2003 |
| WO | 2006/051633 | A1 | 5/2006 |

OTHER PUBLICATIONS

International Search Report for International Application No. PCT/JP2005/016429, mailed on Dec. 13, 2005 (1 page).

esp@cenet patent abstract for Japanese Publication No. JPO8229462, Publication date Sep. 10, 1996 (2 pages).

esp@cenet patent abstract for Japanese Publication No. JP9206377, Publication date Aug. 12, 1997 (1 page).

esp@cenet patent abstract for Japanese Publication No. JP2000262324, Publication date Sep. 26, 2000 (1 page).

esp@cenet patent abstract for Japanese Publication No. JP2004089687, Publication date Mar. 25, 2004 (1 page).

Gazette of Unexamined Utility Model Applications for Japanese Publication No. S60-80718, Publication date Jun. 5, 1985 (3 pages).

Gazette of Unexamined Utility Model Applications for Japanese Publication No. S60-80717, Publication date Jun. 5, 1985 (2 pages).

esp@cenet patent abstract for Japanese Publication No. JP10192050, Publication date Jul. 28, 1998 (1 page).

esp@cenet patent abstract for Japanese Publication No. JP10192049, Publication date Jul. 28, 1998 (1 page).

esp@cenet patent abstract for Japanese Publication No. JP8229461, Publication date Sep. 10, 1996 (1 page).

Concise explanation of relevance for Japanese Publication No. 2004-089687 (1 page).

European Search Report for European Application No. 05782253.8-2313, mailed on Apr. 14, 2009 (6 pages).

* cited by examiner

FILLER EXTRUDING CONTAINER FOR COATING

TECHNICAL FIELD

The present invention relates to a push-out applicator for pushing out and applying an application material.

BACKGROUND ART

Conventional moving body feed devices, which are used to push out a liquid or other such application material contained in an applicator, have been equipped with a base cylinder having on their inside a packing region packed with an application material, and an operating cylinder rotatably provided to the rear end of this base cylinder; when the base cylinder and the operating cylinder are rotated relatively, a moving body held in the base cylinder and the operating cylinder advances, causing a piston provided at the distal end of this moving body to advance, and as a result the application material is pushed out toward the distal end, passes through an opening in a discharge cap mounted at the distal end of the base cylinder, and is applied to the application surface (see Patent Document 1 for an example of such a moving body feed device). Other such moving body feed devices have been disclosed in Patent Documents 2-7.

Patent Document 1: Japanese Laid-Open Patent Application 2000-262324

Patent Document 2: International Laid-Open Patent Application WO03/017799

Patent Document 3: Japanese Laid-Open Utility Model Applications S60-80717

Patent Document 4: Japanese Laid-Open Utility Model Applications S60-80718

Patent Document 5: Japanese Laid-Open Patent Application H10-192049

Patent Document 6: Japanese Laid-Open Patent Application H10-192050

Patent Document 7: Japanese Laid-Open Patent Application H8-229461

DISCLOSURE OF THE INVENTION

Problem to be Solved by the Invention

With the above devices, however, even when the moving body advances as far as it can, some of the application material remains on the inside of the distal end of the discharge cap, and ends up not being used, so improvement is needed in this respect.

The present invention is conceived in an effort to solve this problem, and it is an object thereof to provide an economical push-out applicator with which almost none of the application material is left unused.

Means for Solving the Problem

The push-out applicator of the present invention is a push-out applicator having a region filled with a material to be applied, with said material being discharged through a discharge opening provided at the distal end of the applicator as a moving body disposed within the applicator advances, wherein the inner and outer faces of a distal end member having the discharge opening at the distal end of the applicator are sloped faces, and an elastic body, which hits the sloped inner face and elastically deforms along said sloped face when the moving body has advanced as far as it can, is provided to the distal end of the moving body.

With a push-out applicator such as this, since the outer face of the distal end member having a discharge opening at the applicator distal end is a sloped face, skin or another surface to be coated can be coated favorably, and when the moving body advances as far as it can, the elastic body provided to the distal end of the moving body hits the sloped face that is the inner face of the distal end member having the discharge opening at the distal end of the applicator, and elastically deforms along said sloped face, and the application material that could not be pushed out with a conventional piston and would remain in a substantially hoof-shaped (sloped cylindrical) space (a space including the sloped face within the applicator distal end) can be completely pushed out by the elastic body, leaving almost none behind, so that all of it can be consumed.

A specific example of a structure that effectively exhibits the above-mentioned action is one in which the applicator is equipped with tubular bodies that are mutually rotatably linked and hold the moving body, and has a anti-rotation member for the moving body and a threaded member with male and female threads that allow the movement of the moving body when these tubular bodies are rotated relatively.

Also, if a space is provided on the inside of the elastic body, this space will facilitate elastic deformation and allow even more of the application material to be pushed out.

Also, the above-mentioned action will be exhibited even more effectively if the elastic body is made of silicone rubber. If the external shape of the elastic body when not deformed is in rotational symmetry around the axis of the moving body, the application material can be pushed out uniformly.

The present invention will be understood even more clearly from the following detailed description and the appended drawings. These are merely given as examples, however, and should not be construed as limiting the present invention.

Effects of the Invention

With the push-out applicator pertaining to the present invention, it is possible to provide an economical push-out applicator with which almost none of the application material is left unused.

EXPLANATION OF REFERENCE NUMERALS

1 tip cylinder
1*a* outer face of distal end of applicator
1*b* inner face of distal end of applicator
1*c* discharge opening
1*x* packing region
2 base cylinder (tubular body)
3 operating cylinder (tubular body)
3*b* rotation stop (anti-rotation member)
4*a* female threads (threaded member)
6 moving body
6*a* male threads (threaded member)
6*b* rotation stop (anti-rotation member)
9 elastic body
9*d* space for elastic body
100 push-out applicator
L application material

BEST MODE FOR CARRYING OUT THE INVENTION

Preferred embodiments of the push-out applicator pertaining to the present invention will now be described with reference to FIGS. 1 to 10.

Figure 1:
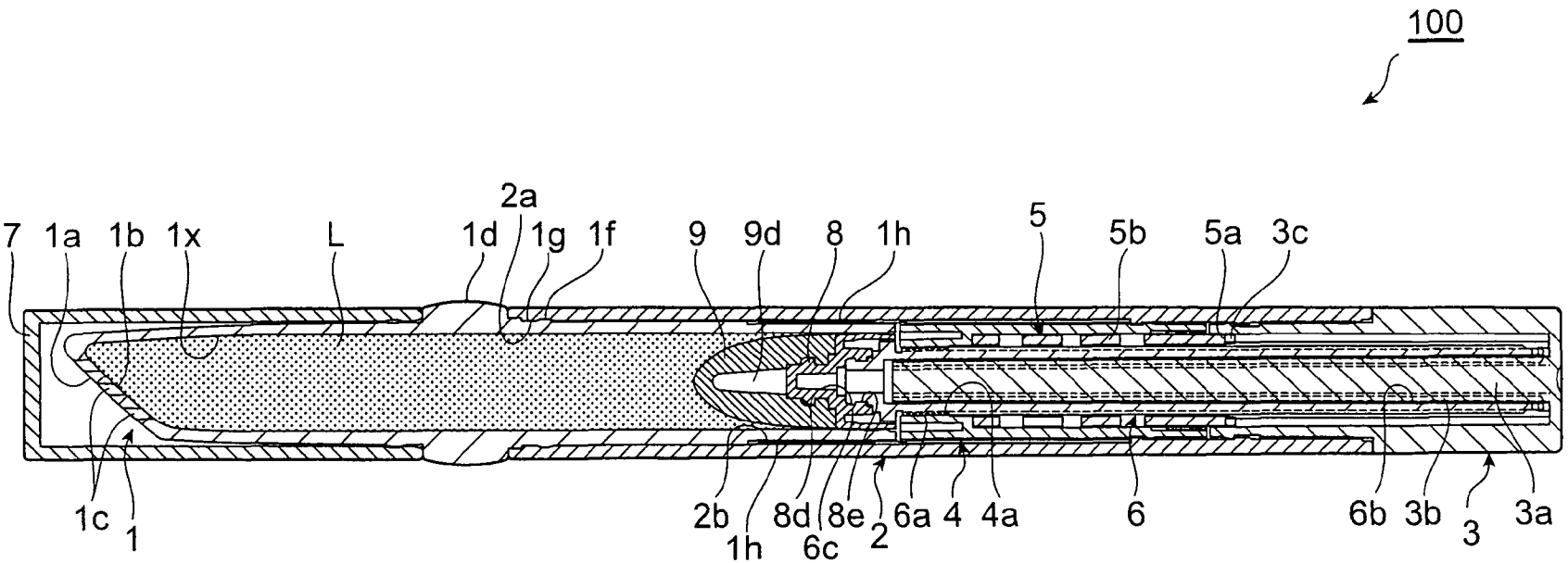
FIG. 1 is a vertical cross section of the push-out applicator pertaining to an embodiment of the present invention, and illustrates the state before the moving body has been fed out.
Figure 2:
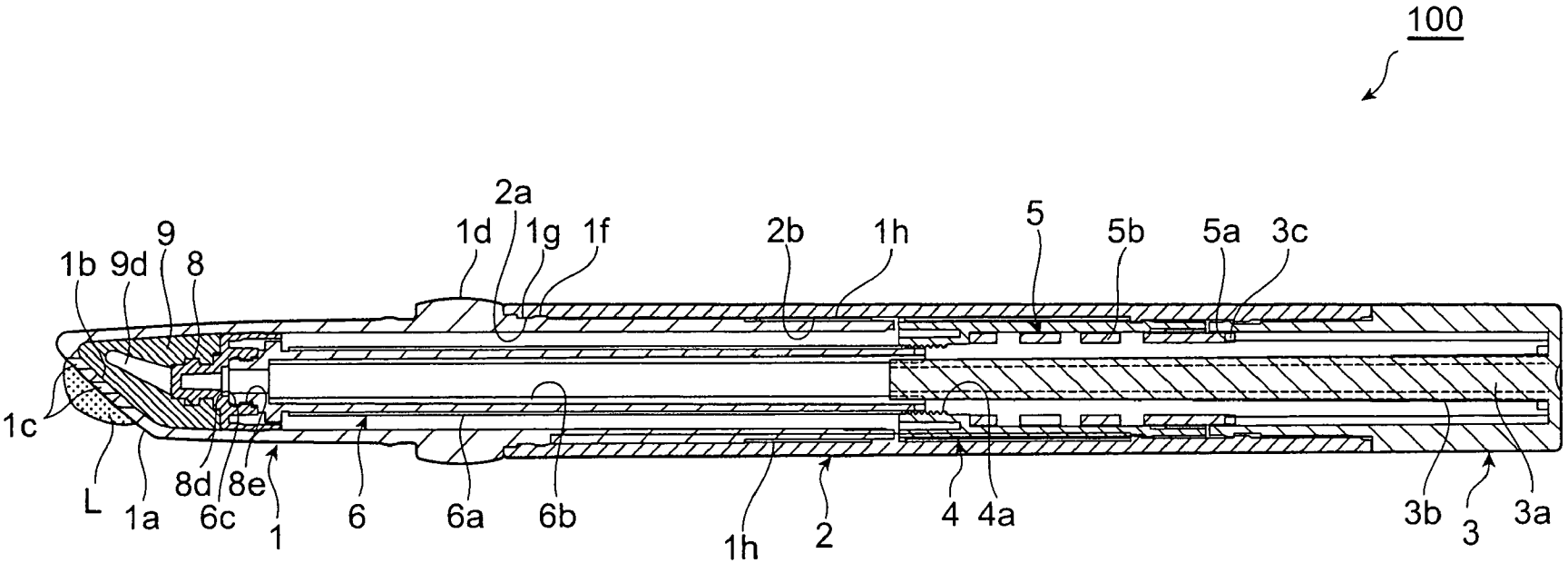
FIG. 2 is a vertical cross section of when the cap has been removed from the push-out applicator pertaining to an embodiment of the present invention, and illustrates the state when the moving body has advanced as far as possible.
Figure 7:
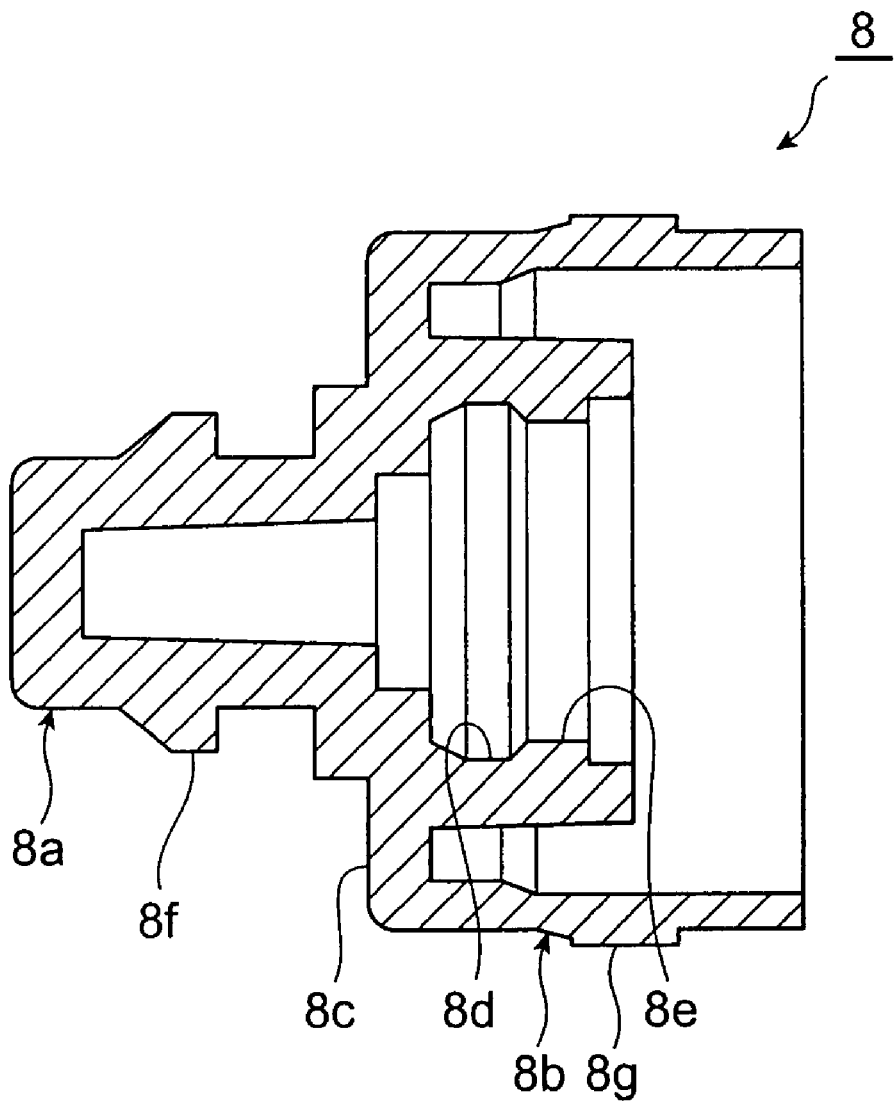
FIG. 7 is a vertical cross section of the piston in FIGS. 1 and 2.
Figure 8:
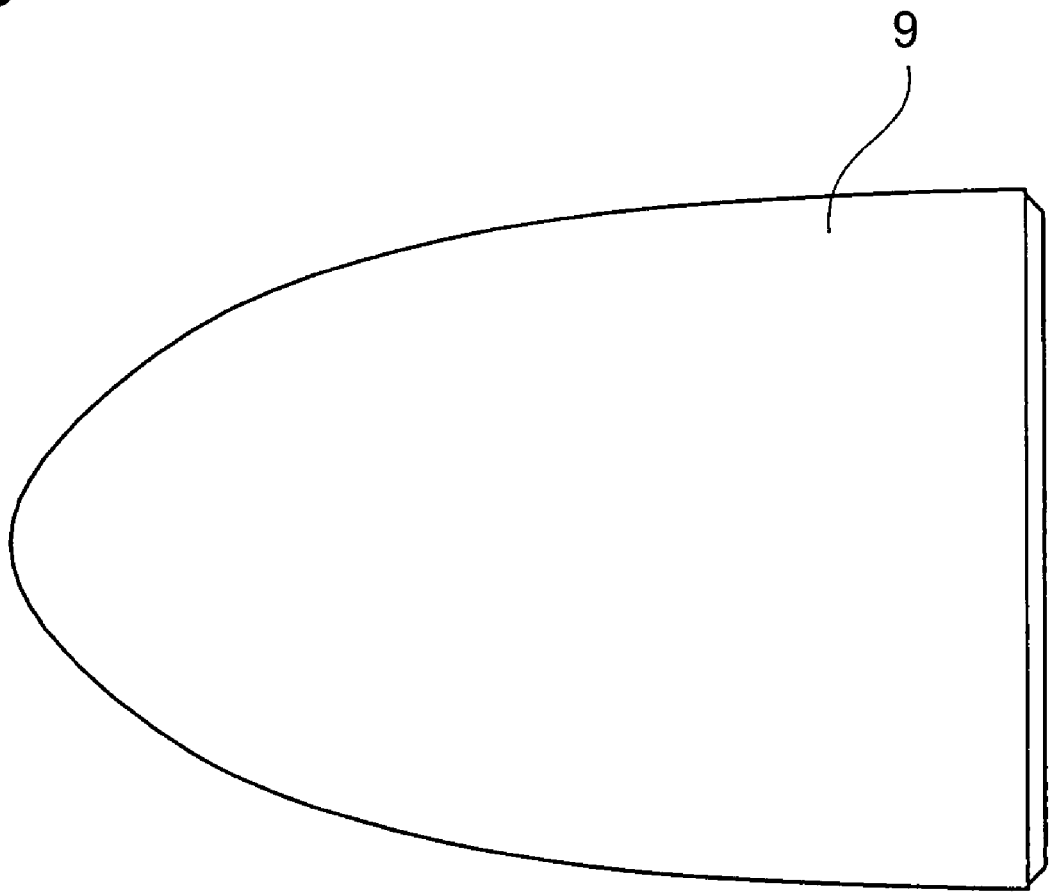
FIG. 8 is a side view of the elastic body shown in FIGS. 1 and 2.
Figure 9:
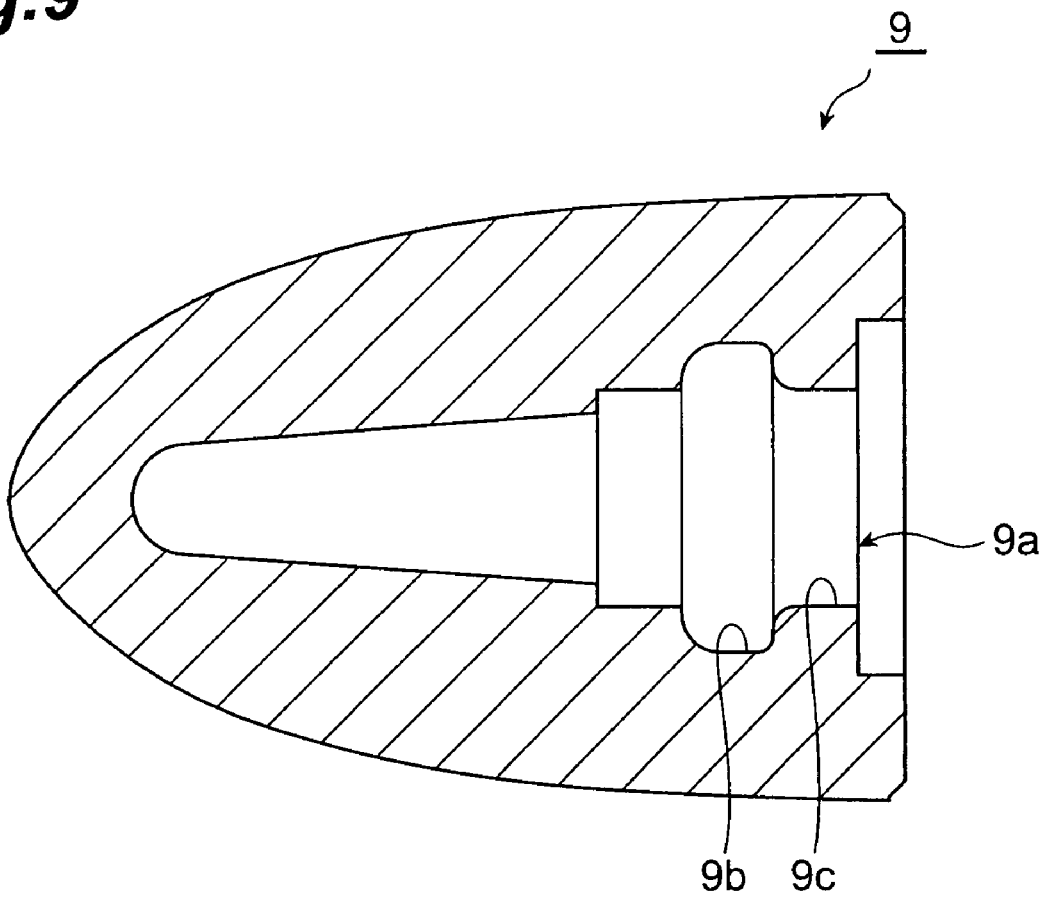
FIG. 9 is a vertical cross section of the elastic body shown in FIG. 8.
Figure 10:
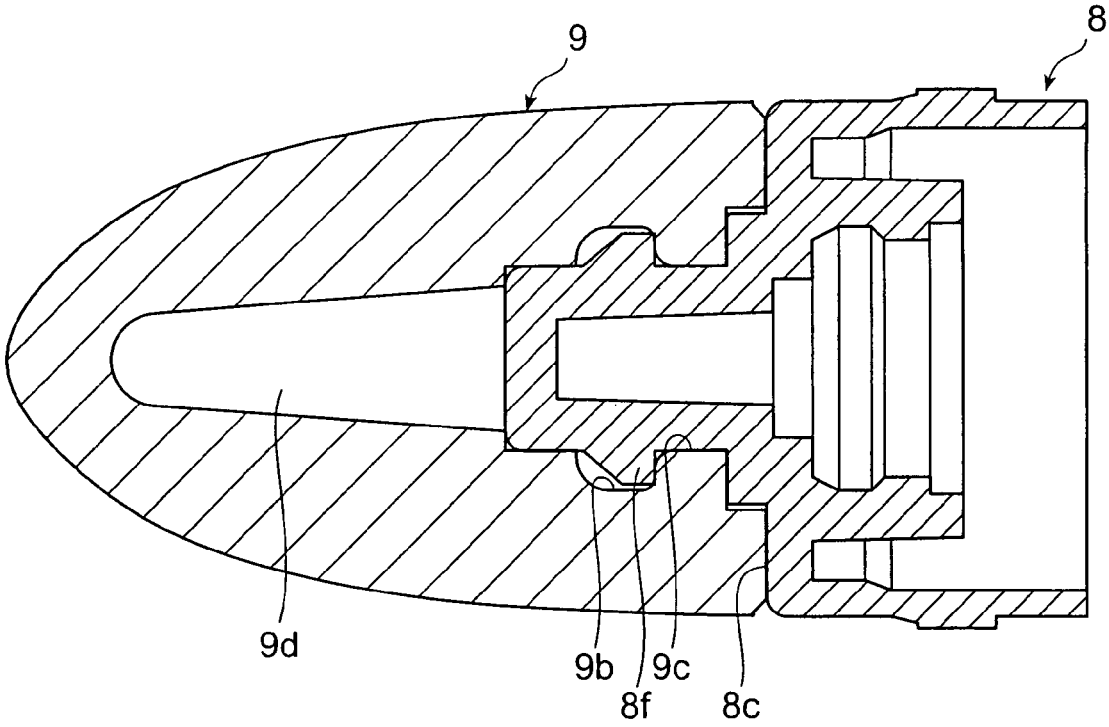
FIG. 10 is a vertical cross section in which the elastic body shown in FIGS. 8 and 9 has been mounted to the piston shown in FIG. 7.

FIG. 1 is a vertical cross section of the push-out applicator pertaining to an embodiment of the present invention, and illustrates the state before the moving body has been fed out. FIG. 2 is a vertical cross section of the push-out applicator when the moving body has advanced as far as possible. FIGS. 3 to 6 are diagrams of the tip cylinder. FIG. 7 is a vertical cross section of a piston. FIGS. 8 and 9 are diagrams of the elastic body, while FIG. 10 is a vertical cross section of when the elastic body is mounted to a piston. The push-out applicator in this embodiment holds an application material, and allows this application material to be pushed out by suitable operation by the user.

A lip gloss is used here as a particularly favorable example of the application material, but the application material is not limited to this, and can also be other lip care products, eye shadow, eyeliner, liquid foundation, cleansing liquid, nail enamel, nail care solution, nail polish remover, mascara, anti-aging products, hair coloring, hair care products, oral care products, massage oil, ink for marking pens and other such writing instruments, liquid medicines, and other such liquid, solid, and semisolid pastes, gels, and so forth.

First, the constitution of the push-out applicator will be briefly described. As shown in FIGS. 1 and 2, the push-out applicator 100 comprises, as its external configuration, a tip cylinder 1, the interior of which is equipped with a packing region 1*x* that is packed with an application material L; a base cylinder (tubular body) 2 into the front half of which is inserted the rear half of the tip cylinder 1, thereby linking the tip cylinder 1 non-rotatably and non-movably in the axial direction; and a bottomed, operating cylinder (tubular body) 3 that is linked rotatably and non-movably in the axial direction to the rear end of the base cylinder 2. This applicator 100 further comprises, as the mechanism for pushing out the application material L in the base cylinder 2 and the operating cylinder 3, a cylindrical shaft body 3*a* that is provided at the bottomed part of the operating cylinder 3 and has formed around its outer peripheral surface a rotation stop 3*b* extending in the axial direction; a threaded cylinder 4 that is linked non-rotatably and non-movably in the axial direction to the base cylinder 2 and has female threads 4*a* formed around its inner peripheral surface; a bumpy specific engagement part 3*c* formed in the inner peripheral direction on the inner peripheral distal end face of the operating cylinder 3; and a cylindrical click spring member 5 that is disposed between the threaded cylinder 4 and the specific engagement part 3*c* of the operating cylinder 3, and is non-rotatably engaged with the threaded cylinder 4. The click spring member 5 has a compression spring part 5*b* in the middle part thereof and a bump part 5*a* at its rear end face that is pressed against the specific engagement part 3*c* of the operating cylinder 3 by the compression spring part 5*b* and click-engages with the engagement part 3*c*. This applicator 100 further. comprises a cylindrical moving body 6 into which the shaft body 3*a* is inserted so as to go through the click spring member 5 and the threaded cylinder 4. The moving body 6 has formed on its inner peripheral surface a rotation stop 6*b* that engages with the rotation stop 3*b* of the shaft body 3*a*, and has formed on its outer peripheral surface male threads 6*a* that mesh with the female threads 4*a* of the threaded cylinder 4 and that extend in the axial direction.

With this push-out applicator 100, when the user rotates the base cylinder 2 (or the tip cylinder 1 described in detail below) relative to the operating cylinder 3 with perceiving tactile feeling, the moving body 6 moves straight ahead or backward under the control of a meshing mechanism (threaded part) made up of the male threads 6*a* of the moving body 6 and the female threads 4*a* of the threaded cylinder 4, an anti-rotation mechanism (anti-rotation part) made up of the rotation stop 3*b* of the shaft body 3*a* and the rotation stop 6*b* of the moving body 6, and a click mechanism made up of the bump part 5*a* and the compression spring part 5*b* of the click spring member 5 and the specific engagement part 3*c* of the operating cylinder 3.

Let us now describe the tip cylinder 1 that constitutes the front half of the push-out applicator 100, and the elastic body 9 mounted to the distal end of the moving body 6. First, the tip cylinder 1 will be described in detail.

The tip cylinder 1 holds the application material L, and discharges the application material L from the distal end part when the user places the distal end part against the application surface and operates the applicator. Accordingly, the material of which the tip cylinder 1 is made is preferably an injected molded plastic such as polyethylene terephthalate (PET) or polypropylene (PP), and is also preferably a transparent material. If a transparent material is used, then even when a cap 7 has been mounted on the tip cylinder 1, the color of the application material L can be discerned from the outside, looking through a bulging portion 1*d* where the tip cylinder 1 is exposed and not covered by the cap 7.

Figure 3:
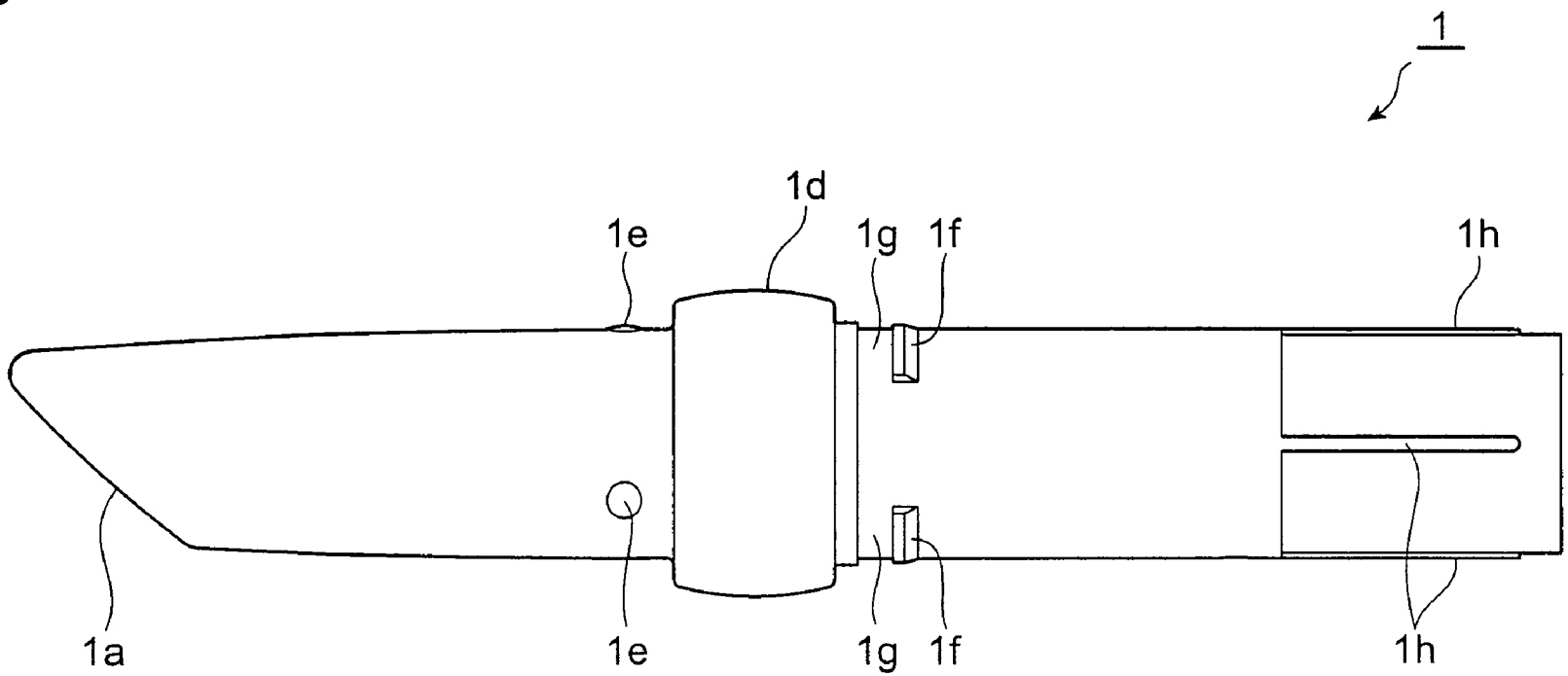
FIG. 3 is a side view illustrating the tip cylinder shown in FIGS. 1 and 2.
Figure 4:
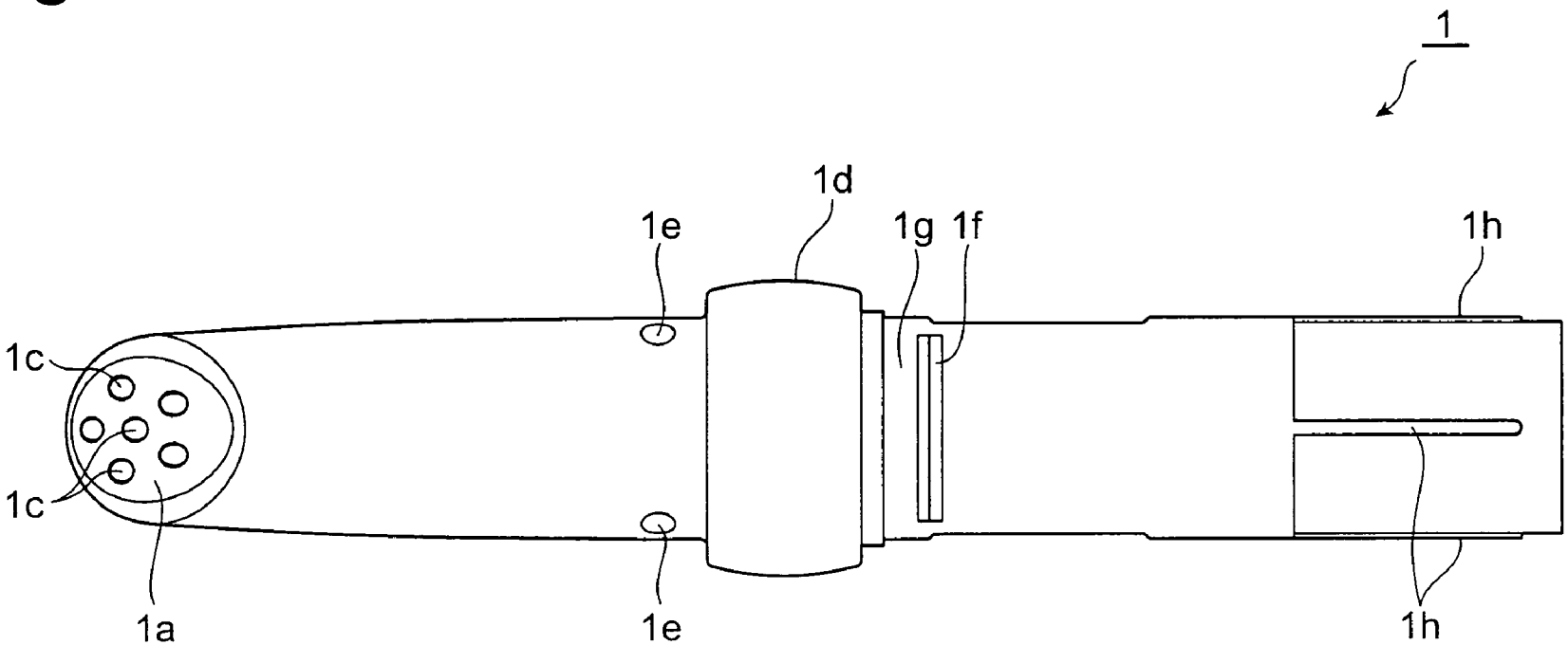
FIG. 4 is a bottom view of the tip cylinder shown in FIG. 3.
Figure 5:
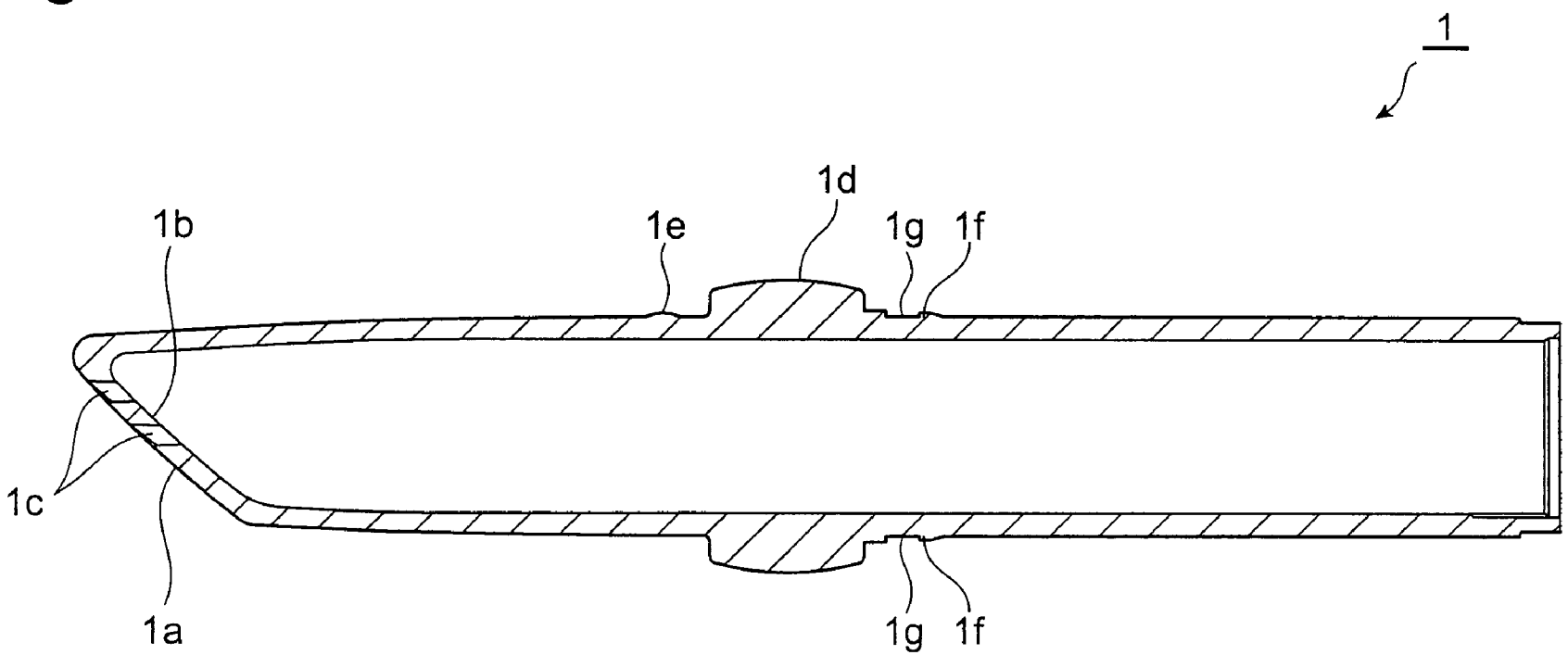
FIG. 5 is a vertical cross section of the tip cylinder shown in FIG. 3.
Figure 6:
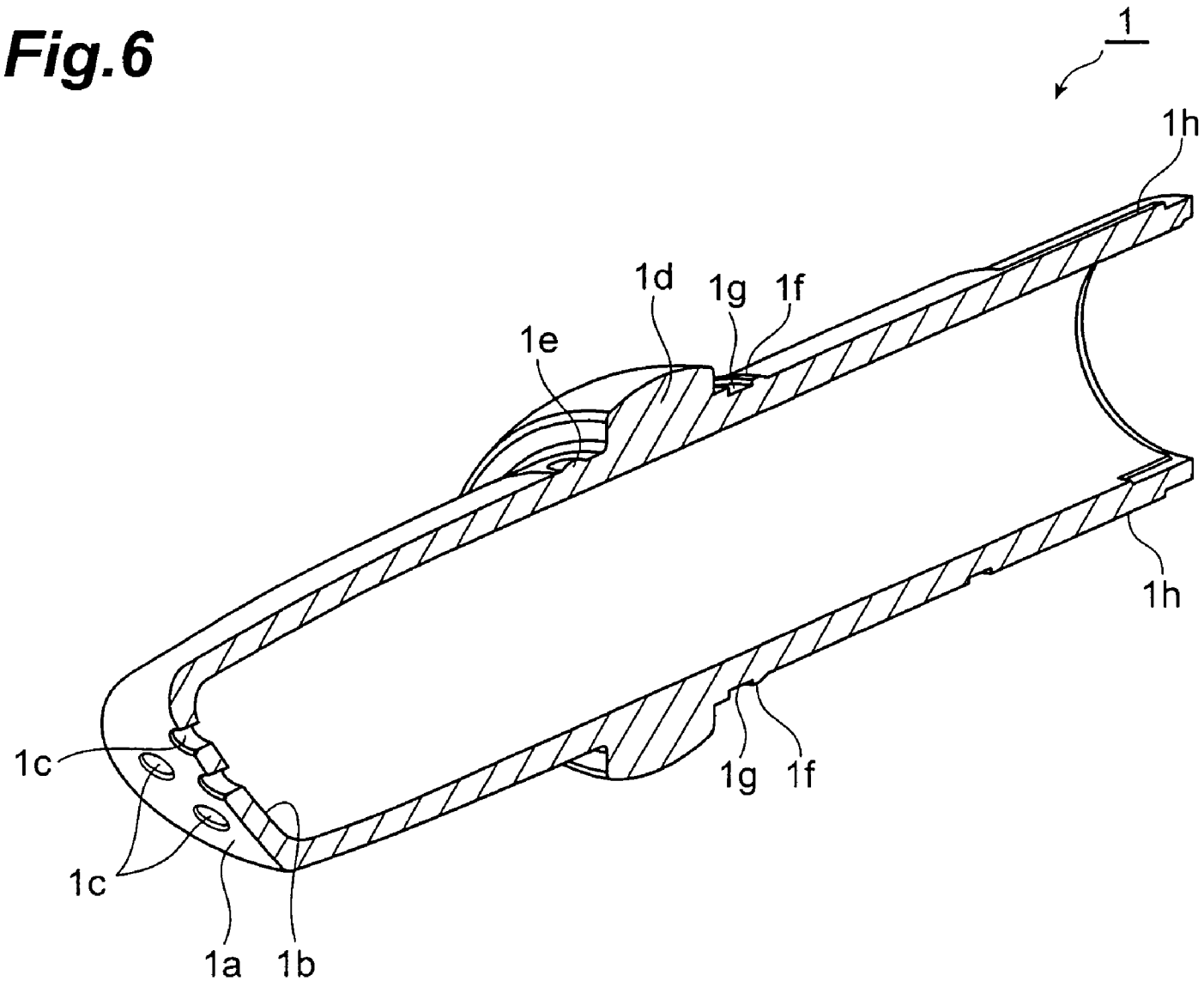
FIG. 6 is a vertically cut-away oblique view of the tip cylinder shown in FIGS. 3 to 5.

As shown in FIGS. 3 to 6, the tip cylinder 1 is cylindrical in shape, and as shown in FIGS. 3 to 5, the outer face 1*a* that serves as the coating face of the distal end part is a sloped face, which is sloped with respect to the axial direction of the tip cylinder 1 to facilitate the coating of the application surface, such as the skin. As shown in FIG. 5, an inner face 1*b*, which is a sloped face that is sloped along the outer face 1*a*, is formed at the distal end part of the tip cylinder 1, a certain thickness away from the outer face 1*a*. Also, a plurality of discharge openings 1*c* are provided for allowing the inner face 1*b* and the outer face 1*a* to communicate and for discharging the application material L packed inside the tip cylinder Also, as shown in FIGS. 3 to 6, the bulging portion 1*d*, whose outside diameter is increased so as to strike the open end on the distal end side of the base cylinder 2, is provided to the outer peripheral surface of the tip cylinder 1 in the approximate middle in the axial direction. Also, protrusions 1*e* (known as dowels) for detachably latching in the axial direction the cap 7 (see FIG. 1) that covers the part of the tip cylinder 1 ahead of the bulging portion 1*d* are provided at three equidistant locations in the peripheral direction, these locations being ahead of the bulging portion 1*d*. Two convex parts 1*f* that extend in an arc shape in the peripheral direction are provided across from each other around the outer peripheral surface of the tip cylinder 1 at locations behind the bulging portion 1*d*. The concave parts extending in an arch shape are provided at locations front the convex parts 1*f*, and ribs 1*h* that extend in the axial direction are provided at four equidistant locations in the peripheral direction, the locations being at the rear end. The concave parts 1*g* and the convex parts 1*f* provided next to each other in the axial direction (see FIG. 5) are used to engage the tip cylinder 1 with the base cylinder 2 in the axial direction, and the ribs 1*h* are used to engage the tip cylinder 1 with the base cylinder 2 in the rotational direction.

The tip cylinder 1 is inserted from its rear end side into the base cylinder 2, and as shown in FIGS. 1 and 2, the rear end face of the bulging portion 1*d* strikes the open end of the base cylinder 2 on its distal end side, the concave parts 1*g* and the convex parts 1*f* engage with an annular protrusion 2*a* provided around the inner peripheral surface on the distal end side of the base cylinder 2, and the ribs 1*h* engage with knurling 2*b* consisting of numerous bumps provided to the inner peripheral surface of the base cylinder 2 in the approximate center in the axial direction. As a result, the tip cylinder 1 is mounted on the base cylinder 2 non-rotatably and non-movably in the axial direction, and is integrated with the base cylinder 2. The cap 7 can also be mounted on the tip cylinder 1, as shown in FIG. 1.

The elastic body 9 is mounted via a piston 8 at the distal end of the moving body 6. As shown in FIG. 7, the piston 8 is in the form of a stepped cylinder that is closed at its distal end, and has an internal shape that accommodates the distal end part of the moving body 6. The front half of this piston 8 serves as a small-diameter cylindrical part 8*a* that is inserted into the elastic body 9, and a large-diameter cylindrical part 8*b* that is linked to this cylindrical part 8*a* via a stepped face 8*c* serves as a sliding part that slides watertightly through the tip cylinder 1.

An annular concave part 8*d* and convex part 8*e* for engaging with the moving body 6 in the axial direction are provided next to each other in the axial direction around the inner peripheral surface of the piston 8. An annular protrusion 8*f* for engaging with the elastic body 9 in the axial direction is provided around the outer peripheral surface of the piston 8, at the small-diameter cylindrical part 8*a* thereof, and an annular protrusion 8*g* for ensuring a water-tight seal is provided in close contact with the inner peripheral surface of the tip cylinder 1, at the large-diameter cylindrical part 8*b* thereof.

The elastic body 9 is formed from a soft elastic material that readily undergoes elastic deformation, such as silicone rubber. Materials that can be selected other than silicone rubber include nitrile rubber (NBR), ethylene propylene rubber (EPR), butyl rubber (IIR), and other such thermosetting materials formed by compression molding, and polyurethane-based elastomers (TPU), polyolefin-based elastomers (TPO), polyester-based elastomers (TPEE), and other such thermoplastic materials formed by injection molding.

As shown in FIGS. 8 and 9, this elastic body 9 is bell-shaped, tapering toward its distal end, and as shown in FIG. 9, it is equipped with a stepped concave part 9*a* extending from the rear end face specifically toward the distal end side, and an annular concave part 9*b* and convex part 9*c* for engaging with the annular protrusion 8*f* of the piston 8 in the axial direction are provided next to each other in the axial direction on the rear side of the concave part 9*a*.

This elastic body 9 is inserted from its rear side over the piston 8, the rear end face thereof hits the stepped face 8*c* of the piston 8 as shown in FIG. 10, and the concave part 9*b* and convex part 9*c* engage with the annular protrusion 8*f* of the piston 8, so that the elastic body 9 is mounted to the piston 8 rotatably and non-movably in the axial direction. In this state, a space 9*d* is provided within the elastic body 9 between the piston 8 that has advanced into the concave part 9*a*, on the front side thereof. This space 9*d* serves to promote the elastic deformation of the elastic body 9.

The piston 8 to which the elastic body 9 has been mounted is inserted from the rear side thereof over the distal end part of the moving body 6, and as shown in FIGS. 1 and 2, the concave part 8*d* and convex part 8*e* engage with an annular protrusion 6*c* provided to the distal end part of the moving body 6, thereby mounting the piston 8 to the moving body 6 rotatably and non-movably in the axial direction.

With the push-out applicator 100 configured in this way, the dimensions, layout, and other such settings are such that when the moving body 6 has advanced as far as it can, the elastic body 9 will be pushed on by the sloping inner face 1*b* of the distal end part of the tip cylinder 1.

With this push-out applicator 100, as discussed above, when the user relatively rotates the base cylinder 2 or the tip cylinder 1 and the operating cylinder 3 in the direction of advance of the moving body 6 with perceiving tactile feeling, the moving body 6 moves forward, the application material L packed in the tip cylinder 1 is pushed out forward by the elastic body 9, discharged from the discharge openings 1*c*, and applied.

As shown in FIG. 2, particularly with the push-out applicator 100 of this embodiment, when the relative rotation provided by the user advances the moving body 6 as far as it can go, the elastic body 9 elastically hits the sloped inner face 1*b* of the distal end part of the tip cylinder 1, and elastically deforms along said sloped face. At this point, the elastic body 9 elastically deforms even more favorably due to the space 9*d* in the elastic body 9. The result of this elastic deformation of the elastic body 9 is that the application material L that would remain in the substantially hoof-shaped (sloped cylindrical) space (a space including the sloped face within the applicator distal end) and could not be pushed out with a conventional piston can be thoroughly pushed out, leaving almost none behind, so that all of it can be consumed. Accordingly, economical push-out applicator 100 can be provided with which almost none of the application material L is left unused.

Also, with the push-out applicator 100 of this embodiment, since the application material L is discharged by elastically deforming the elastic body 9 so that it conforms to the inner face 1*b* of the distal end part of the tip cylinder 1, even if there should be some looseness or dimensional error in the parts, the elastic deformation of the elastic body 9 will absorb this, so that the elastic body 9 can still conform to the inner face 1*b*, allowing the application material L to be thoroughly taken out. Also, the elastic body 9 and the inner face 1*b* do not have to be precisely positioned during the assembly of the applicator 100, which simplifies the assembly work. Furthermore, because there is a good seal between the elastic body 9 and the piston 8, rearward leakage of the application material L can be suppressed while the moving body 6 is pushing out.

The present invention was described in specific terms above on the basis of an embodiment thereof, but the present invention is not limited to the above embodiment. For example, the moving body 6 is configured to move forward and backward in the above embodiment, but a ratchet mechanism that permits only the rotation for forwarding the moving body 6 may be used instead of a click mechanism.

Naturally, fine bristles or the like may also be provided to the sloped outer face 1*a* of the tip cylinder 1.

Also, it is particularly favorable in the above embodiment if the push-out mechanism of the push-out applicator 100 is a rotational mechanism involving the meshing mechanisms 4*a* and 6*a*, but it is also possible to employ a knock-type push-out mechanism or the like.

Furthermore, the above-mentioned male threads 6*a* encompass a group of protrusions laid out intermittently, or a group of protrusions laid out spirally and intermittently, having the same function as threads, and the above-mentioned female threads 4*a* encompass a group of protrusions laid out intermittently, or a group of protrusions laid out spirally and intermittently, having the same function as threads.

Also, the elastic body 9 was described as being bell-shaped, tapering toward its distal end, but the outer shape of the elastic body 9 is not limited to this, and may instead be hemispherical or the like. However, the elastic body 9 has an outer shape that does not slope along the inner face 1*b* of the tip cylinder 1 when there is no deformation, but rather hits the inner face 1*b* when the moving body 6 has advanced as far as it can, and conforms to the sloped face only upon elastic deformation. From the standpoint of pressing uniformly on the application material L, the external shape of the elastic body 9 when not deformed is in rotational symmetry around the axis of the moving body 6, such as the above-mentioned bell shape, or a hemispherical shape.

The invention claimed is:

1. A push-out applicator, having a region filled with a material to be applied, with said material being discharged through a discharge opening provided at a distal end of the applicator as a moving body disposed within the applicator advances, wherein inner and outer faces of a distal end part having the discharge opening at the distal end of the applicator are sloped faces, an elastic body, which hits the sloped inner face and elastically deforms along said sloped face when the moving body has advanced as far as the moving body can, is provided to a distal end of the moving body, a space is provided on the inside of the elastic body, an external shape of the elastic body when not deformed is in rotational symmetry around an axis of the moving body, and the external shape of the elastic body when not deformed is bell-shaped, tapering toward the distal end of the applicator or is hemispherical.

2. The push-out applicator according to claim 1, wherein the applicator comprises tubular bodies that are mutually rotatably linked and hold the moving body, and has an anti-rotation part for the moving body and a threaded part with male and female threads that allow the movement of the moving body when the tubular bodies are rotated relatively.

3. The push-out applicator according to claim 1, wherein the elastic body is made of silicone rubber.

4. A push-out applicator comprising:

a tip cylinder having a top wall and a peripheral wall, said walls constituting a region filled with a material to be applied;

a moving body, disposed within the applicator, which advances in said tip cylinder;

an elastic body, provided to a distal end of said moving body, configured to press said material forward; and a discharge opening, provided on said top wall of said tip cylinder, is configured to discharge said material as said moving body advances; wherein inner and outer faces of said top wall are sloped with respect to an axis of said applicator, and said elastic body hits said sloped inner face and elastically deforms along said sloped inner face when said moving body has advanced at a maximum;

a space is provided on the inside of the elastic body, an external shape of the elastic body when not deformed is in rotational symmetry around an axis of the moving body, and the external shape of the elastic body when not deformed is bell-shaped, tapering toward the distal end of the applicator or is hemispherical.

5. The push-out applicator according to claim 4, further comprising:

a base cylinder into which the rear part of said tip cylinder is inserted non-rotatably and non-movably in the axial direction; and an operating cylinder linked rotatably and non-movably in the axial direction to said base cylinder;

wherein said moving body advances in said tip cylinder as said operating cylinder is rotated to said base cylinder.

6. The push-out applicator according to claim 5, wherein said tip cylinder has a bulging portion having an outside diameter larger than that of the other portion of said tip cylinder and an open end of said base cylinder strikes said bulging portion.

7. The push-out applicator according to claim 6, further comprising a cap into which a front part of said tip cylinder is inserted;

wherein an open end of said cap strikes said bulging portion so as to sandwich said bulging portion with said base cylinder.

8. The push-out applicator according to claim 7, wherein at least said bulging portion of said tip cylinder is made of transparent material.

9. The push-out applicator according to claim 4, wherein said elastic body is made of silicone rubber.

10. The push-out applicator according to claim 4, wherein said tip cylinder is made of transparent material.

* * * * *